United States Patent [19]

Knowlton

[11] Patent Number: 4,630,463

[45] Date of Patent: Dec. 23, 1986

[54] RIVET DRIVING DIE AND METHOD

[75] Inventor: Dale E. Knowlton, Renton, Wash.

[73] Assignee: The Boeing Company, Seattle, Wash.

[21] Appl. No.: 675,771

[22] Filed: Nov. 28, 1984

[51] Int. Cl.[4] ..... B21J 13/02

[52] U.S. Cl. ..... 72/479; 72/476; 411/507; 29/509

[58] Field of Search ..... 227/51, 52, 53; 173/128; 29/243.53, 509; 72/391, 453.19, 476, 479, 467; 411/501, 504, 506, 507

[56] References Cited

U.S. PATENT DOCUMENTS

| | | | |
|---|---|---|---|
| 1,443,532 | 1/1923 | Gray | 72/479 |
| 1,966,401 | 7/1934 | Andren | 411/507 |
| 2,061,660 | 11/1936 | Komosis | 72/479 |
| 3,561,102 | 2/1971 | Diemer | 411/507 |
| 3,962,775 | 6/1976 | King, Jr. | 72/476 |
| 4,065,951 | 1/1978 | Lyu | 72/479 |

*Primary Examiner*—Francis S. Husar
*Assistant Examiner*—David B. Jones
*Attorney, Agent, or Firm*—Hughes & Cassidy

[57] ABSTRACT

A die particularly adapted to drive a rivet, where the head of the rivet has a relatively steep circumferential side surface. The die engages the rivet head in a manner that initially the middle portion of the die driving surface exerts substantial force into the shank portion of the rivet, after which the die driving surface comes in greater overall driving engagement with the entire rivet head. Further, the die has a circumferential lip which limits lateral movement of the die relative to the rivet head.

8 Claims, 6 Drawing Figures

RIVET DRIVING DIE AND METHOD

BACKGROUND OF THE INVENTION

1. Field of the Invention

The present invention relates to a die and method for driving a rivet and more particularly to such a die which is configured in a particular way relative to the shape of the rivet head to drive the rivet in an improved manner, and to the method performed in the use of the die.

2. Background Art

It is a general practice in the aircraft industry, as well as in other industries, to join metal parts to one another by means of rivets. One common type of rivet is one having a generally cylindrical shank portion that fits into the hole that is formed through the two parts which are to be joined, and a head portion having a diameter moderately larger than that of the shank, with this head fitting against an outer surface of one of the parts to be joined. To set the rivet, a bucking bar or anvil is positioned against the outwardly protruding end of the shank, while a rivet gun is placed against the head of the rivet.

More specifically, the rivet gun is provided with a die that has an impact end that is contoured to fit against the head of the rivet. In operation, the rivet gun has a mass which is mounted in the gun chamber for reciprocating motion. When the gun is operated, this mass impacts or hammers against the die, with the impact forces imposed on the die being transmitted into the rivet. The protruding end portion of the shank is upset (i.e. expanded), and the main portion of the shank that remains in the hole generally expands slightly so as to be in proper engagement with the cylindrical surfaces of the two parts that define the hole or opening in which the rivet is placed.

While the above described operation of fastening metal pieces by rivets is on the surface a relatively simple mechanical operation, there are complexities which lead to more subtle considerations relating to the effectiveness of the connection made by the rivet. With regard to the connecting function of the rivet itself, generally the major forces which are exerted on the rivet are sheer forces (i.e. opposing forces directed perpendicular to the lengthwise axis of the shank of the rivet which would tend to cause one part of the rivet to sheer laterally from the other). Further, for the rivet to be an effective load bearing member, it is necessary for the rivet to be in proper contact with the hole forming surfaces of the two metal parts along substantially the entire length of that hole.

Another important consideration is that the driving of the rivet should be accomplished in a manner so as to minimize any possibility of structural damage to the parts being joined. Since material must be removed to form the holes for the rivets, the structural loads must be carried by the remaining material of the piece surrounding the rivet holes. This makes it essential that this remaining material surrounding the holes not be stressed, scratched or otherwise damaged so as to diminish its load carrying capacity.

The rivet configuration which has been used quite commonly in the aircraft industry for a number of years is one where the head has a lower annular flat surface adapted to engage the outer surface portion of one of the parts that surrounds the rivet hole. The upper surface of the rivet head then curves upwardly and inwardly in a radial direction from the circumference of the lower head surface toward a middle portion of the rivet head. Then the top middle surface portion of the rivet head is nearly flat or only moderately rounded. The die which is in the rivet gun and which contacts the rivet head has at its end a recess which substantially matches the contour of the upper surface of the rivet head. In general, this particular die configuration has been found to work effectively with this type of rivet.

A more recent development was to modify the configuration of the head of the rivet by eliminating a certain amount of rivet material at the outer circumferential portion of the rivet head, and also eliminating a small amount of material from the top middle surface portion of the rivet head. Not only does this produce a small weight saving for each rivet (which weight saving can become significant when one considers the large number of rivets used in an entire airplane structure), but this permitted the rivet holes to be spaced more closely to certain structural components so that there could be a savings in the amount of material used for the structure itself. For example, when a right angle section is being joined to a flat piece, the curved juncture portion where the two flanges of the angle section meet is a critical structural area which should not be damaged in any way. By reducing the diameter of the rivet head, it is possible to move the rivet holes closer to the location of the curved portion of the angle section without causing damage to or interferring in any way with the structural integrity of the curved juncture portion of the angle section.

The present invention is directed particularly to the problems associated in driving a rivet having the modified head configuration as described immediately above. A search of the patent literature has revealed a number of patents relating generally to riveting machines. In general, while the patents resulting from the search deal with various aspects of the riveting process, these patents were not particularly informative relative to the problems toward which the present invention is directed. Accordingly, these patents are listed below without any specific comments. These patents are:

U.S. Pat. No. 1,180,028, Gooding;
U.S. Pat. No. 3,147,647, Downes;
U.S. Pat. No. 3,491,930, Hill;
U.S. Pat. No. 3,557,442, Speller;
U.S. Pat. No. 3,672,553, Doring;
U.S. Pat. No. 3,977,229, Alvi et al;
U.S. Pat. No. 4,060,189, Vargo Jr. et al;
U.S. Pat. No. 4,101,064, Vargo Jr. et al;
West German No. 750,369.

In view of the foregoing, it is an object of the present invention to provide a die for driving a rivet and also a method of driving the rivet, which die and method are particularly adapted to work effectively with the modified type of rivet head described above.

SUMMARY OF THE INVENTION

The die of the present invention is arranged to impact a rivet where the rivet comprises an elongate shank and a head attached to one end of the shank. The shank has a lengthwise axis and is adapted to fit through an opening in the material to be riveted together, where the material has a top surface, a bottom surface, and an annular surface defining the opening and extending between the top and bottom surfaces.

The head has a generally circular configuration relative to planar cross-sections perpendicular to the longitudinal axis. The head further comprises:

1. a first bottom annular surface adapted to engage an annular top surface portion of the top surface of the material;
2. a second circumferential generally laterally facing surface portion extending upwardly from said bottom annular surface with a substantial alignment component parallel to the lengthwise axis;
3. a third upper middle central surface portion that is substantially planar;
4. a fourth upper annular intermediate surface portion that is convexly curved and extends between said central surface portion and said lateral surface portion.

The die comprises an end driving portion which comprises:

a. an annular outer circumferential containing lip portion, having a fifth lower annular surface portion and a sixth inwardly facing annular containing surface portion extending upwardly from the first lower annular surface portion;
b. a recessed driving portion located within the lip portion, said driving portion having a seventh middle main contact surface portion and an eighth intermediate secondary contact surface portion extending between the seventh main contact surface portion and said sixth containing surface portion.

The seventh surface portion and the eighth surface portion are configured and located relative to the third and fourth surface portions of the rivet head so that when the driving end portion of the rivet is placed over the rivet head in driving relationship, and the die is impacted to drive the rivet, the seventh surface portion initially comes into driving contact with the third surface portion so that a major portion of the driving force from the die is transmitted through the third surface portion to in turn submit substantial driving force directly into the shank. Thereafter, the eighth surface portion comes into greater driving engagement with said fourth surface portion.

The sixth surface portion is arranged relative to the second lateral surface portion so that when the die is impacted to drive the rivet, the sixth surface portion is sufficiently close to the second surface portion so as to properly locate the end driving portion of the die laterally relative to the rivet head. The fifth surface portion is arranged so that it remains spaced upwardly from the top surface of the material that is being riveted together.

In the preferred form, the maximum clearance between the eighth and fourth surface portions is between about one half of a thousandth to 0.002 inch, and more preferably not greater than about 0.001 inch. Also, the preferred form is that the sixth surface portion is, with the die in driving engagement with the rivet head, in substantial alignment with the lengthwise axis of the die. Preferably, this alignment is such that it is within 5° alignment with the longitudinal axis.

The sixth inwardly facing annular surface is located so that it would be within about 0.002 inch relative to the second surface portion of the rivet.

In the method of the present invention, a die is provided as described above. The die is impacted against the rivet so that the initial force is directed more through the middle portion of the rivet head directly into said shank, after which there is greater driving engagement outwardly of the middle portion.

Other features of the present invention will become apparent from the following detailed description.

DETAILED DESCRIPTION OF THE PREFERRED EMBODIMENT

Figure 1:
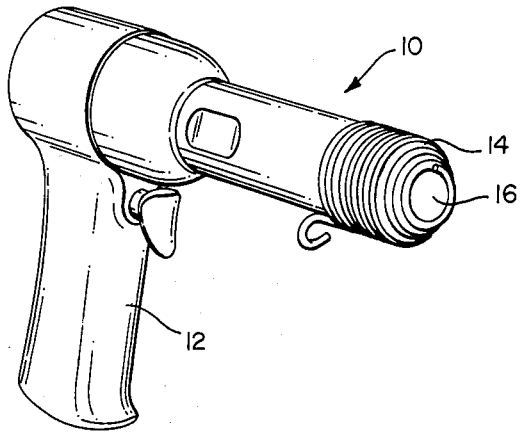
FIG. 1 PRIOR ART
FIG. 1 is an isometric view of a typical rivet gun which can be used in conjunction with the present invention.

In FIG. 1, there is shown a conventional rivet gun 10, having a handle 12 and an operating end 14 in which a die 16 is mounted. A typical prior art die 16 is shown in FIG. 2 engaging a prior art rivet 18, such as those which have been used in the aircraft industry for a number of years.

In general, the rivet 18 comprises a shank 20 and a head 22. The head 22 has a lower annular surface 24 with outer circumferential edge 26. The top surface of the head 22 comprises an outer top surface portion 28 which slopes in a convex curve upwardly and radially inwardly from the circumferential edge 26 toward a middle top surface portion 30. The middle top surface portion 30 is shown as being substantially planar, but can be made with a very moderately rounded configuration.

The die 16 is formed at its operating end with a recess 32 having a configuration which substantially matches that of the top surface portions 28–30 of the rivet head 22. More specifically, the recess 32 has a middle surface portion 34 matching the middle top surface portion 30 of the head 22, and an outer concavely curved surface portion 36 which matches the convex outer top surface portion 28 of the rivet head 22. Surrounding the recess 32 is an annular lower flat edge surface portion 38 which, with the die 16 being positioned so as to be in contact with the head 22 (as shown in FIG. 2), is generally coplanar with the lower surface 24 of the head 22.

Figure 2:
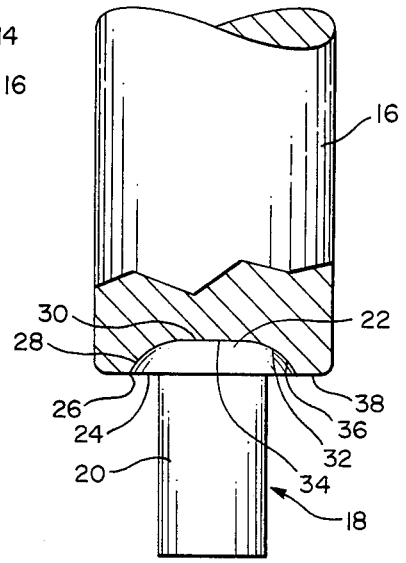
FIG. 2 PRIOR ART
FIG. 2 is a elevational view, partly in section, illustrating the configuration of a prior art rivet die and an earlier prior art type of rivet, with the die being in operating contact with the head of the rivet.

In the operation of the prior art die 16 and rivet 18, as shown in FIG. 2, the die 16 would be subjected to a series of impacts or hammer strokes while a bucking bar or anvil is held against the opposite end of the rivet 18 (i.e. against the protruding end of the shank 20). In general, it has been found that with proper quality control procedures, the rivet 18 can be driven into proper connecting engagement.

Figure 3:
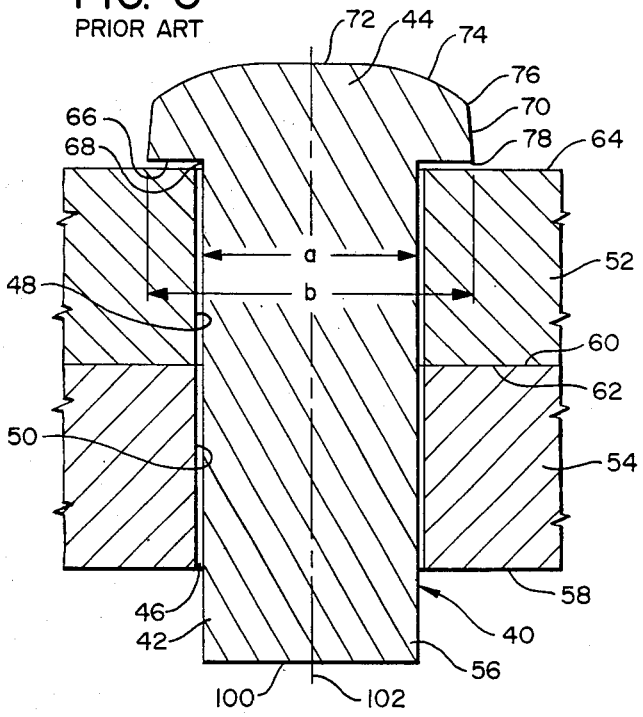
FIG. 3 PRIOR ART
FIG. 3 is a sectional view taken through the lengthwise axis of a modified type of prior art rivet and illustrating the manner in which it is used to join two pieces to one another.

As an improvement to the prior art arrangement shown in FIG. 2, there was devised a rivet of a somewhat modified configuration, and this is illustrated in FIG. 3. This improved or modified rivet is generally designated 40 and comprises a cylindrical shank 42 and a head 44. The shank 42 is shown as being positioned in a through hole 46 defined by aligned upper and lower cylindrical surfaces 48 and 50, respectively, formed in upper and lower metal plates 52 and 54, respectively. The lower end 56 of the shank 42 extends moderately below the lower surface 58 of the plate 54. The upper surface 60 of the lower plate 50 is in contact with the lower surface 62 of the upper plate 52. The plate 52 is designated 64. The shank 42 has the same general overall configuration as the shank 20 of the prior art rivet 18.

The head 22 has a lower annular surface portion 66 surrounding the upper circumferential edge 68 of the shank 42 (this circumferential edge 68 actually being a 90° circumferential corner). The head 44 also has a circumferential lateral surface portion 70 which has a generally cylindrical configuration that has a rather moderate radially inward slant of approximately 5° off the vertical, or moderately less than 5°.

The top surface of the rivet head 44 comprises an upper middle surface portion 72 which as shown is substantially planar, but which can be rounded upwardly to a moderate degree. The upper head surface further comprises an upper intermediate surface portion 74 that surrounds the central surface portion 72 and slopes downwardly and radially outwardly therefrom in a convex curve to meet the lateral surface portion 70 at a juncture line 76. This juncture line 76 is not a sharp edge, but it is moderately rounded. The diameter of the circumferential lateral surface portion 70 at its lower edge 78 (indicated at "a" in FIG. 3) is approximately one and one half times the diameter of the rivet shank 42 (indicated at "b" in FIG. 3).

The die of the present invention, which is particularly adapted to drive a rivet such as that shown at 40 in FIG. 3, will now be described with reference to FIG. 4. This die, generally designated 80, has a major body portion, the lower part of which is shown at 82, and an end driving portion 84. The end driving portion 84 comprises an annular outer circumferential containing lip portion 86 and a recessed driving portion 88 positioned radially within the lip portion 86. The lip portion 86 has a radially inwardly facing containing surface portion 90 and a rounded lower edge surface portion 92, having a radius of 93, for example, 0.019 inch to drive a 5/32 inch diaxeter rivet and a radius of 0.047 inch to drive a ⅜ inch rivet.

The recessed driving portion 88 has a middle main contact surface portion 94 and an intermediate secondary contact surface portion 96. This intermediate surface portion 96 surrounds the middle surface portion 94 and blends into the contour of the middle portion 94. The surface portion 96 extends outwardly from the surface portion 94 in a gradual convex curve to meet the containing surface portion 90 at a juncture line or corner 98. This line or corner 98 is curved about a relatively small radius (e.g. 0.015 inch).

The diameter of the middle main contact portion 94 (this diameter indicated at "c" in FIG. 4) is approximately equal to the diameter of the upper middle surface portion 72 of the rivet head 44, and is approximately twice the diameter (indicated at "b") of the shank 42.

The lower peripheral edge 92 of the lip portion 86 is located relative to the surface portions 94 and 96, so that when the die 80 is in a position to engage the rivet head 44, the surface 92 is positioned a moderate distance above the lower surface 66 of the rivet head 44. This distance is illustrated at "d" in FIG. 4, and for a rivet having a shank diameter of 5/32 inch, this clearance dimension would be about 2/100 inch. For a rivet shank diameter of ⅜ inch, this clearance dimension "d" would be about 0.047 inch.

Figure 4:
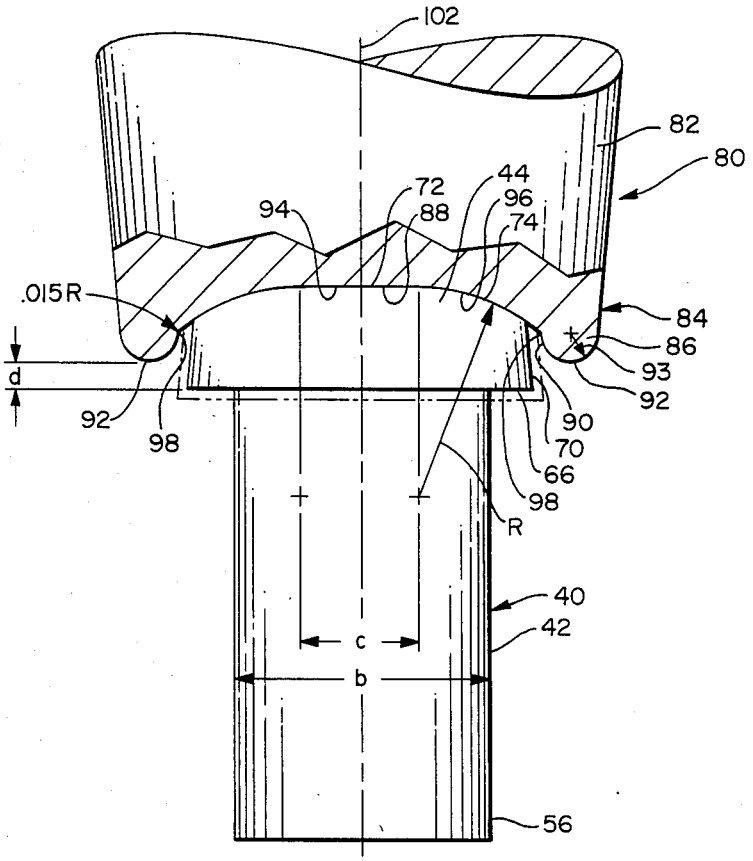
FIG. 4 is an elevational view, partly in section, looking toward the side of the driving end of the die of the present invention, with an associated rivet, such as shown in FIG. 3, being shown somewhat schematically.

The containing surface 90 is arranged so that when the die 80 is in its contact position with the rivet 40, as shown in FIG. 4, this surface 90 is positioned slightly outside of the lateral surface portion 70 of the rivet head 44 by a small clearance dimension (e.g. between about 0.001 to 0.002 inch). Thus, the surface portion 90 serves a locating function in that it locates the die 80 relative to the rivet head 44 so as to limit lateral relative movement therebetween. However, the containing surface 90 does not serve any significant force transmitting function into the rivet 40. To illustrate the tolerances of the dimensions of the rivet head 44, the head 44 is shown in full lines as well as in broken lines. The spacing of those lines is somewhat exaggerated in FIG. 4, but the tolerance would be in the order of between 0.0005 to 0.002 inch, and desirably about 0.001 inch or less.

The middle surface portion 94 and the intermediate surface portion 96 of the die 80 are arranged relative to the middle surface portion 72 and intermediate surface portion 74 of the rivet head 44, so that when the die 80 is in the position of FIG. 4, there is a very small amount of clearance between the die intermediate surface portion 96 and the rivet head intermediate surface portion 74. More specifically, the radius "R" of the surface 96 is such that the clearance between the surface portion 96 and the head surface portion 74 expands in a radially outward direction. The maximum amount of such clearance, which would be toward the radially outward part of the surface portions 74 and 96, would be between about 0.0005 to 0.001 inch.

To describe the operation of the present invention, let it be assumed that the two plates 52 and 54 which are to be riveted together (see FIG. 3) have been formed with the through hole 46 so as to provide the two cylindrical surface portions 48 and 50 which define the hole 46. The rivet 40 is placed in the opening 46, so that the lower surface portion 66 of the head 44 rests against the upper surface 64 of the plate 52. Normally the diameter of the shank 42 will be just slightly smaller than that of the hole 46 (e.g. 1/1000 to about 1/100 inch less) which is in effect the tolerance dimension between the diameter of the hole 46 and the shank 42.

To drive the rivet, the anvil (not shown for ease of illustration) is placed against the bottom surface 100 of the shank 42, and the rivet gun 10 with the die 80 placed therein is positioned so that the die end portion 84 fits over the die head 44, as shown in FIG. 4. When the gun 10 is operated so that a series of impacts are imposed upon the die 80 which in turn impacts against the die head 44. This causes the shank end portion 56 to compress axially and to expand radially outwardly, and also causes a moderate flow of metal within the main portion of the shank 42 so that there is a slight outward expansion of material in the shank 42 so that it bears against the surface portions 48 and 50 of the plates 52 and 54.

Figure 5:
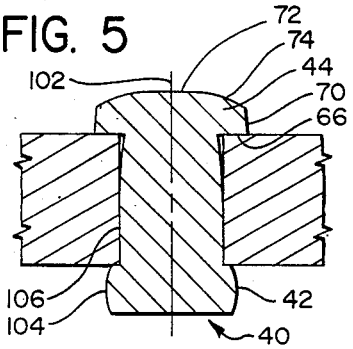
FIG. 5 is a representation of a photograph taken of a rivet, such as shown in FIG. 3, being driven by a prior art die, with the rivet and the metal piece being cut along a plane coinciding with the lengthwise center axis of the rivet so as to disclose its internal structure after being driven.

With regard to the precise manner in which the rivet material is displaced or flows during the impacting of the rivet to form the finished connection, the manner in which this generally takes place is believed to be generally understood, but there are likely sole facets or subtleties which are not completely understood. To amplify on this, reference is made to FIG. 5 which is a photograph of a section of a rivet and an associated plate where the plate and rivet have been cut away along a plane coincident with the longitudinal or lengthwise centerline 102 of the rivet 40. The rivet shown in FIG. 5 is the modified type of rivet illustrated in FIG. 3, but this was driven by a conventional rivet die, such as that shown in FIG. 2, with the die being somewhat undersized so as to be in better engagement with the rivet head 44. It can be seen that the lower end of the shank 42 has been compressed axially and has expanded outwardly as at 104. At the same time, the portion of the shank that is within the plate opening has expanded outwardly in the opening. A close examination of this photograph indicates that at the lower portion of the hole (i.e. at 106), the rivet material has flowed outwardly so as to be in tight contact with the surface defining the hole. However, at the upper part of the shank 42 the flow of the material has been such that there is a very small gap between the rivet shank 42 and the surface defining the hole. The existence of this gap does not permit the rivet 40 to achieve its full potential in carrying the sheer loads between the plates that are being joined. (It should be explained that the plate illustrated in FIG. 5 is actually a single plate, instead of two plates which are joined together, this being done for convenience in performing the test.)

Figure 6:
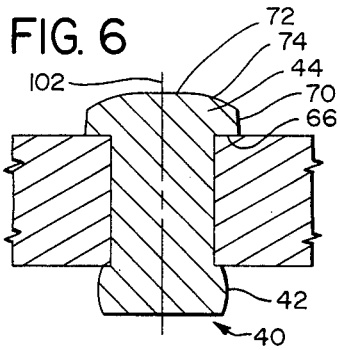
FIG. 6 is a view similar to FIG. 5, but showing a rivet, such as that shown in FIG. 3, after being driven with the die of the present invention.

FIG. 6 is a representation of a photograph taken in substantially the same manner as the photograph of FIG. 5, except that the rivet 40 was driven by the die 80 of the present invention. Closer examination reveals that the flow of rivet material was such that there is quite adequate contact of the shank material 44 along substantially the entire length of the plate hole.

With regard to the manner in which the die 80 of the present invention transmits its impact forces into the rivet 40 to make a rivet connection, it is believed that the following hypothesis can be proposed with a certain amount of justification. First, it should be recognized that the annular contact surface 66 of the rivet head 44 has a relatively small area in the particular rivet configuration. It is theorized that it would be desirable to have a lesser amount of force impacted directly through the surface portion 66 to minimize potential weakening of the plate material immediately below the rivet head surface 66. Further, it is theorized that it would be more desirable to have the rivet 40 impacted so that the forces would be transmitted more through the central portion of the rivet 40 (i.e. be impacted closer to the longitudinal center axis 102), so that there would be a greater tendency for a small amount of flow parallel to the axis 102 so that the shank 42 would tend to expand outwardly more uniformly against all parts of the plate surfaces defining the hole. Thus, it is believed that in the operation of the die 80 of the present invention, during the initial impacting of the die 80, the greater portion of the impact force is transmitted from the middle die surface portion 94 directly into the upper middle surface portion 72 of the rivet head 44. Thus, these impact forces would be directed downwardly and outwardly in an expanding direction to enhance the flow of material in the upper part of the shank 42 so as to insure greater engagement of the shank surface in the area of the upper surface portion 48 of the plate 52. (It will be noted that in FIG. 5 it is this upper area of the hole where there is insufficient contact with the shank of the rivet.)

After the greater impacting of the central portion 72 of the rivet head 44, there can be a greater percentage of the force exerted against the intermediate surface portion 74 of the rivet head 44 because of a slight deformation of the head 44 to complete the driving of the rivet 40. During the driving, the containing surface 90 cooperates with the lateral circumferential surface 70 of the rivet head 44 to perform more of a locating function of the die 80 relative to the rivet 40.

It is to be emphasized, however, that even though the hypothesis given above is inaccurate or in some respects incorrect, it has been found that the die 80 of the present invention does operate quite effectively to properly drive the rivet such as shown in FIG. 3, to accomplish a proper rivet connection. Further, it is to be understood that certain modifications could be made in the die 80 without departing from the basic teachings of the present invention.

I claim:

1. A method of driving a rivet, where the rivet comprises:

a. an elongate shank having a lengthwise axis and being adapted to fit through an opening in material to be riveted together, where the material has a top surface, a bottom surface, and an annular surface defining said opening and extending between said top and bottom surfaces;

b. a head attached to one end of the shank, the head having a generally circular configuration relative to planar cross sections perpendicular to the longitudinal axis, said head comprising:

1. a first bottom annular surface adapted to engage an annular top surface portion of the top surface of the material;
2. a second circumferential generally laterally facing surface portion extending upwardly from said bottom annular surface with a substantial alignment component parallel to the lengthwise axis;
3. a third upper middle central surface portion that is substantially planar;
4. a fourth upper annular intermediate surface portion that is convexly curved and extends between said central surface portion and said lateral surface portion;

said method comprising:

a. providing a die having an end driving portion which comprises:

1. an annular outer circumferential containing lip portion, having a fifth lower annular surface portion and a sixth inwardly facing annular containing surface portion extending upwardly from the first lower annular surface portion;
2. a recessed driving portion located within the lip portion, said driving portion having a seventh metal middle main contact surface portion and an eighth intermediate secondary contact surface portion extending between the seventh main contact surface portion and said sixth containing surface portion;

b. arranging said seventh middle contact surface portion and said eighth secondary contact surface portion relative to the third upper central surface portion and the fourth intermediate surface portion of the rivet head so that when the end driving portion of the die is placed over the rivet head in driving relationship, least part of said eighth surface portion is spaced from said fourth surface portion;

c. impacting said die to drive the rivet, so that said seventh surface portion initially comes into driving contact with the third surface portion so that a major portion of driving force from the die is transmitted through said third surface portion to in turn transmit substantial driving force directly into said shank, after which said eighth surface portion comes into greater driving engagement with said fourth surface portion;

d. utilizing said sixth containing surface portion, which is configured and sized relative to the second lateral surface portion to fit closely around said second surface portion, to properly locate the end driving portion of the die laterally relative to the rivet head;

e. arranging said fifth lower annular surface portion relative to the seventh and eighth surface portions so that with the seventh and eighth surface portions coming into driving engagement with the third and fourth surface portions, said fifth surface portion remains spaced upwardly from the top surface of the material that is being riveted together.

2. The method as recited in claim 1, wherein with said seventh surface portion in contact with said third surface portion, there is a maximum clearance between said eighth surface portion and said fourth surface portion of between about 0.0005 to 0.002 inch.

3. The method as recited in claim 2, wherein said maximum clearance is no greater than about 0.001 inch.

4. The method as recited in claim 1, wherein said sixth inwardly facing surface portion is, with the die in driving engagement with the rivet head, in substantial alignment with the lengthwise axis of the die.

5. The method as recited in claim 4, wherein said sixth surface portion is within at least five degrees alignment with said longitudinal axis.

6. The method as recited in claim 1, wherein with said die in driving engagement with said rivet head, the sixth inwardly facing annular surface portion is located within about 0.002 inch with said second surface portion of the rivet.

7. The method as recited in claim 1, wherein:

a. with said seventh surface portion in contact with said third surface portion, there is a maximum clearance between said eighth surface portion and said fourth surface portion of between about 0.0005 to 0.002 inch;

b. said sixth inwardly facing surface portion is, with the die in driving engagement with the rivet head, in substantial alignment with the lengthwise axis of the die;

c. with said die in driving engagement with said rivet head, the sixth inwardly facing annular surface portion is located within about 0.002 inch with said second surface portion of the rivet.

8. The method as recited in claim 7, wherein:

a. said maximum clearance is no greater than about 0.001 inch;

b. said sixth surface portion is within at least five degrees alignment with said longitudinal axis.

* * * * *